US010124554B2

(12) United States Patent
Persson et al.

(10) Patent No.: US 10,124,554 B2
(45) Date of Patent: Nov. 13, 2018

(54) ARRANGEMENT IN A CREASING MACHINE, AND PRODUCTS OBTAINED THEREFROM

(71) Applicant: TETRA LAVAL HOLDINGS & FINANCE S.A., Pully (CH)

(72) Inventors: Ola Persson, Löddeköpinge (SE); Daniel Cronqvist, Furulund (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 637 days.

(21) Appl. No.: 14/397,349

(22) PCT Filed: Apr. 19, 2013

(86) PCT No.: PCT/EP2013/058130
§ 371 (c)(1),
(2) Date: Oct. 27, 2014

(87) PCT Pub. No.: WO2013/171019
PCT Pub. Date: Nov. 21, 2013

(65) Prior Publication Data

US 2015/0080200 A1 Mar. 19, 2015

(30) Foreign Application Priority Data

May 14, 2012 (SE) ..... 1250489

(51) Int. Cl.
*B31F 1/08* (2006.01)
*B31F 1/10* (2006.01)
*B31B 50/25* (2017.01)

(52) U.S. Cl.
CPC ..... *B31F 1/08* (2013.01); *B31F 1/10* (2013.01); *B31B 50/256* (2017.08)

(58) Field of Classification Search
CPC ... B31F 1/08; B31B 2201/257; B65H 45/163; B65H 45/168; B65H 45/164
(Continued)

(56) References Cited

U.S. PATENT DOCUMENTS 3,411,419 A * 11/1968 Becker ..... B31B 1/00 156/271
4,287,247 A 9/1981 Reil et al.
(Continued)

FOREIGN PATENT DOCUMENTS

EP 0 176 278 A2 4/1986
GB 1 425 008 A 2/1976
(Continued)

OTHER PUBLICATIONS

International Search Report (PCT/ISA/210) dated Jul. 9, 2013, by the European Patent Office as the International Searching Authority for International Application No. PCT/EP2013/058130.
(Continued)

*Primary Examiner* — Sameh Tawfik
(74) *Attorney, Agent, or Firm* — Buchanan Ingersoll & Rooney PC

(57) ABSTRACT

An arrangement in a cardboard creasing machine, for forming structured patterns of creasing lines in a material comprising a cardboard web fed to the machine, comprising a system of at least two rollers. The first roller is provided with a male die, having at least two envelope surfaces, each with a structured pattern of lines, of which at least one has an open end. In order to prevent wild creasing lines with open ends are provided with crease stoppers, extending perpendicularly to the open line. The second roller is provided with a female die corresponding to the male die.

16 Claims, 5 Drawing Sheets

(58) Field of Classification Search
USPC ..... 493/428
See application file for complete search history.

(56) References Cited

U.S. PATENT DOCUMENTS

| | | | | |
|---|---|---|---|---|
| 4,898,569 | A * | 2/1990 | Focke | B65B 19/228 225/100 |
| 5,001,950 | A * | 3/1991 | Fokos | B26D 7/2628 83/344 |
| 5,429,577 | A * | 7/1995 | Simpson | B26F 1/18 493/354 |
| 5,727,367 | A * | 3/1998 | Cahill | B65B 19/228 493/459 |
| 5,935,367 | A * | 8/1999 | Hollenbeck | B26F 1/44 156/204 |
| 6,209,291 | B1 | 4/2001 | Delen et al. | |
| 6,234,943 | B1 * | 5/2001 | Copin | B26D 5/32 493/11 |
| 6,994,662 | B2 * | 2/2006 | Jornborn | B26D 7/2614 493/402 |
| 7,708,680 | B2 * | 5/2010 | Just | B31F 1/08 493/396 |
| 8,556,789 | B2 * | 10/2013 | Grunder | B41F 13/56 493/340 |
| 2004/0259709 | A1 * | 12/2004 | Guidotti | B65D 5/4266 493/356 |
| 2009/0054220 | A1 | 2/2009 | Just et al. | |

FOREIGN PATENT DOCUMENTS

| | | | |
|---|---|---|---|
| JP | 11320709 | A | 11/1999 |
| JP | 2008536726 | A | 9/2008 |
| RU | 2391213 | C2 | 6/2010 |
| WO | WO 2006/112767 | A1 | 10/2006 |
| WO | WO 2009/131496 | A1 | 10/2009 |

OTHER PUBLICATIONS

International-Type Search Report (PCT/ISA/201) dated Nov. 20, 2012, by the Swedish Patent Office for Application No. 1250489-0.

* cited by examiner

ARRANGEMENT IN A CREASING MACHINE, AND PRODUCTS OBTAINED THEREFROM

TECHNICAL FIELD OF THE INVENTION

The present invention relates an arrangement in a cardboard creasing machine, for forming structured patterns of creasing lines arranged in at least two lanes along the length of a material comprising a cardboard web fed to the machine, wherein the material subsequently is to be cut into blanks, each with a structured pattern of creasing lines. Further the invention relates to a material comprising a cardboard web provided with structured patterns of creasing lines, the structured patterns being arranged in at least two lanes along the length of the web. Especially, the invention relates to measures taken in connection with creasing wear tools that normally cooperate two and two in creating a certain crease pattern to lanes of package blanks comprising cardboard.

BACKGROUND

Creasing of cardboard to obtain a structured pattern of creasing lines is typically performed to facilitate the subsequent folding of the cardboard. As an example, creased cardboard, being part of a packing material and having a structured pattern of creasing lines, may be folded into a package. Typically, blanks to form a package are creased once still being a part of wide web. The wide web may comprise at least two lanes of blanks. Thus, identical structured pattern of creasing lines may be present in lanes adjacent to each other.

Packages for liquid food products have to be essentially liquid proof. For many years packaging materials comprising an innermost thermoplastic layer, to be in contact with the liquid food, a cardboard web, a barrier material, arranged between the innermost thermoplastic layer and the cardboard web, and an outermost thermoplastic polymer layer have been used for this purpose with an excellent result. When producing packages of increased volumes, for instance such containing 1.5 liters or more, the stress on the material however increases and thus the thickness of the cardboard has to be increased.

As a result of the increased thickness there is a tendency of the cardboard web while influenced by male and female dies, as well as different types of rollers in the creasing process, which is positively progressing, to create what is called wild-creases. A wild-crease is an unwanted self-generated crease-like deformation or a defibration of a cardboard material between two close neighboring creases intentionally made. The degree of wild-creasing seems to be the affected by the compression stresses employed to create the intentional creases, the mutual distance between the separated neighboring open ended creases, the depth of each crease and of course the thickness of the creased material. This gives rise to shear stresses in the pulp layers of the cardboard material which may cause delamination or defibration thereof which in turn may produce the wild-creases. The wild-creases occur mainly between two coherent lanes in the modified offset printing process that the process of creasing as a matter of fact is. Typically, wild-creasing occur between the open ends of the adjacent creasing lines (cf. FIG. 1), being perpendicular to the direction of the motion of the cardboard web in the creasing process. The appearance of the wild-creases are thus as an uncontrolled wrinkling of the cardboard in an area between two from one another independent co-linear male dies and more specifically between two separated crease lines.

If wild-creases occur on a package blank in an area where a longitudinal seal is to be made then there is a risk that the package thus produced will be prone to start leaking. The creation of wild-creases here and elsewhere may as another consequence lead to loss of product integrity. These phenomena are of course not acceptable, neither from a producer point of view, nor from the same of a consumer.

As disclosed in WO 2006/112767, the problem of wild creasing may be overcome by providing areas of each the female dies, corresponding to areas where the male dies show interruptions, especially those that run transversally to the running direction of the machine, with a cantilever arrangement. The cantilever arrangement has been shown to be effective in preventing or at least reduce wild creasing. While the cantilever arrangement is effective in preventing wild creasing, it is an expensive and complex technique. Further, it typically requires modification of cardboard creasing machine.

It would be advantageous if wild creasing of cardboard in packaging materials may be prevented, or at least reduced, in an alternative manner, such that the need to provide the female dies with cantilever arrangements may be dispensed with.

SUMMARY OF THE INVENTION

Consequently, the present invention seeks to mitigate, alleviate, eliminate or circumvent one or more of the above-identified deficiencies in the art and disadvantages singly or in any combination by providing the open ends of creasing lines with crease stoppers, at least a vector component of which is extending perpendicularly to the line with the open end. The size of the crease stopper is preferably at least 2 times the width of the line with the open end, and extends on one or both sides of the open line. Especially, the crease stopper is a branching of the one line with an open end.

Thus, an aspect of the invention relates to an arrangement in a cardboard creasing machine, for forming structured patterns of creasing lines in a material comprising a cardboard web fed to the machine, wherein the material comprising the cardboard web subsequently is to be cut into blanks, each with a structured pattern of creasing lines. The arrangement comprises a system of at least two rollers. The first roller is provided with a male die, having at least two envelope surfaces. Each envelope surface has a structured pattern of lines, of which at least one has an open end. Further, the envelope surfaces are arranged parallel to the rotational axis of the first roller. The second roller is provided with a corresponding female die. The rollers are arranged in a manner such that the male and female dies interacts to provide patterns of creasing lines in a material comprising a cardboard web fed to the machine when the machine is used. In the structured pattern of lines, at least one line with an open end is provided with a crease stopper, the size of said crease stopper, extending perpendicularly to the open line, is at least 2 times the width of the line with said open end.

Typically, lines with an open end are a straight lines being parallel to the rotation axis of the rollers. Further, the crease stopper may be a branching of the line with an open end.

Another aspect of the invention relates to a material comprising a cardboard web, the material being provided with structured patterns of creasing lines. The structured patterns are arranged in at least two lanes along the length of the material and the material is adapted to be cut into blanks, each with a structured pattern of creasing lines, of which at least one has an open end. At least one of these lines with an open end is provided with a crease stopper. The size of the crease stopper, perpendicular to the creasing line provided with said crease stopper, is at least 2 times the width of the creasing line provided with the crease stopper. Creasing lines with open ends are typically straight lines arranged perpendicular to the lanes of structured patterns. Further, the crease stopper may be a branching of thee creasing line with an open.

Another aspect of the invention relates to a material comprising cardboard web, as just described, wherein the material is a liquid food packaging material. Such food packaging material may comprise an innermost thermoplastic layer, to be in contact with the liquid food, said cardboard web, a barrier material, arranged between the innermost thermoplastic layer and the cardboard web, and an outermost thermoplastic polymer layer.

Another aspect of the invention relates to a lane of continuous blanks, which may be obtained from the material described herein above, by separating the various lanes of the material.

Another aspect of the invention relates to a lane liquid food package comprising a folded blank cut from the liquid food packaging material described herein above.

Another aspect of the invention relates to a method of providing a material comprising a cardboard web with structured patterns of creasing lines. The method comprises the steps of:

feeding a material comprising a cardboard web to cardboard creasing machine being provided with such an arrangement as described herein above; and passing the cardboard web between the two rollers.

Further advantageous features of the invention are defined in the dependent claims. In addition, advantageous features of the invention are elaborated in embodiments disclosed herein.

BRIEF DESCRIPTION OF THE DRAWINGS

The invention will below be described more in detail, having reference to a preferred embodiment thereof shown on the accomplishing drawings, in which.

DETAILED DESCRIPTION OF PREFERRED EMBODIMENTS

Figure 1:
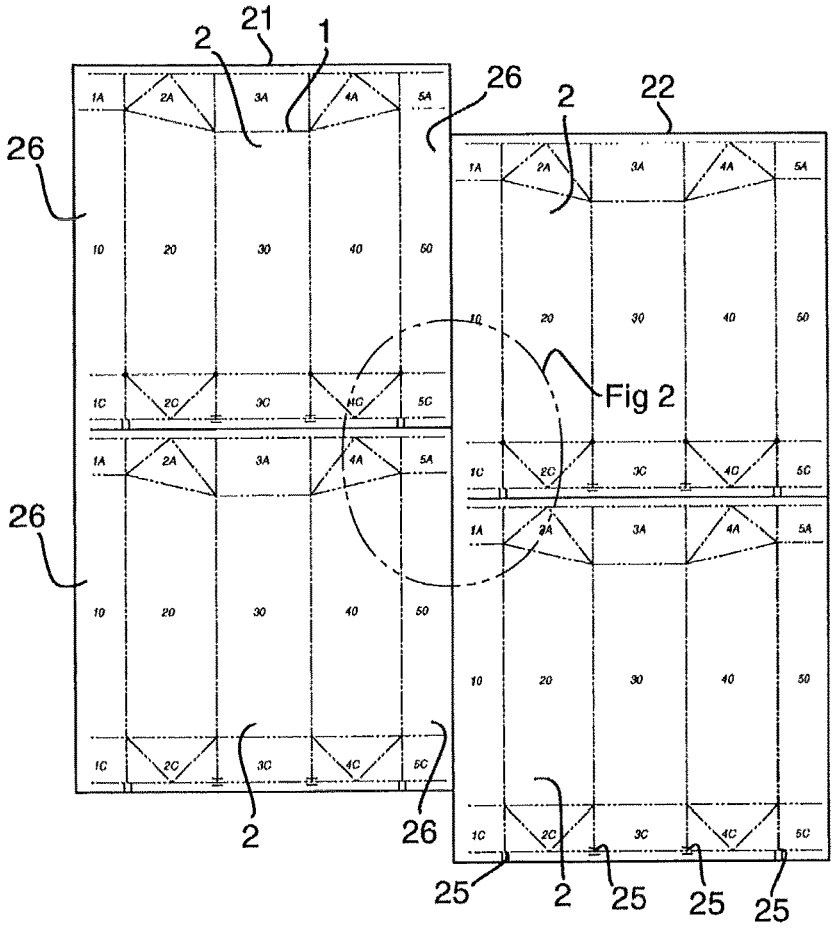
FIG. 1 shows part of a creased cardboard web with in total four blanks 2, arranged in two lanes 21, 22, wherein the blanks 2 in one lane 21 are displaced with respect to blanks in the adjacent lane 22.
Figure 2:
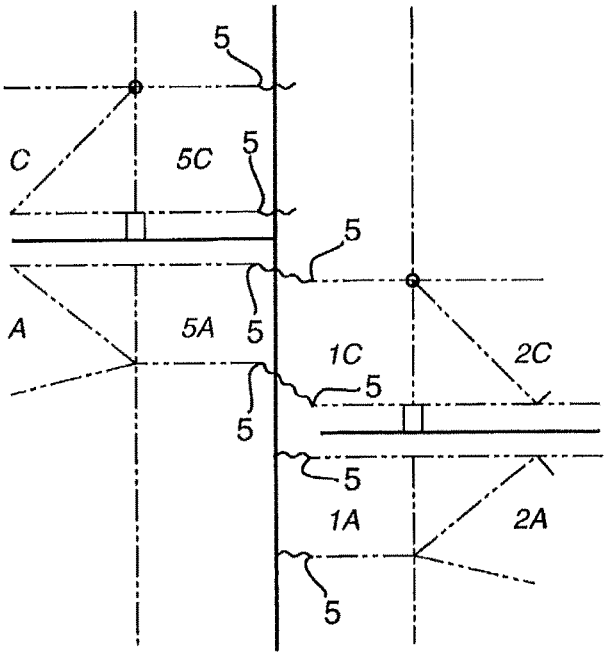
FIG. 2 shows a close up of part of FIG. 1, wherein wild creases running from an open end 5 of a creasing line to the open end 5 of another creasing line is shown.
Figure 3:
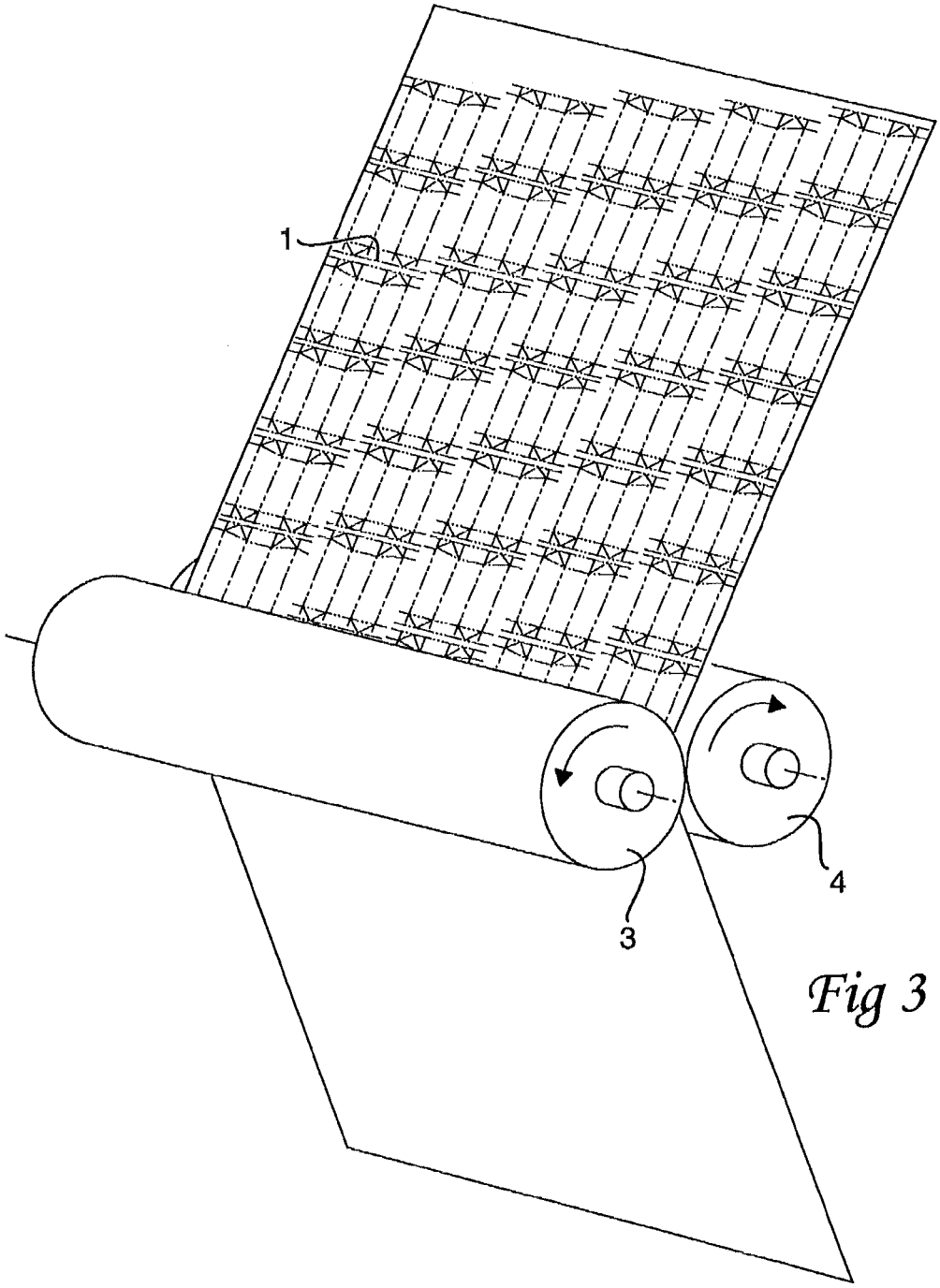
FIG. 3 schematically shows cardboard creasing, wherein two rollers 3, 4, the first roller 3 having male dies 13, and the second roller 4 having female dies 14, provide a material comprising cardboard web with structured patterns of creasing lines 1.
Figure 4:
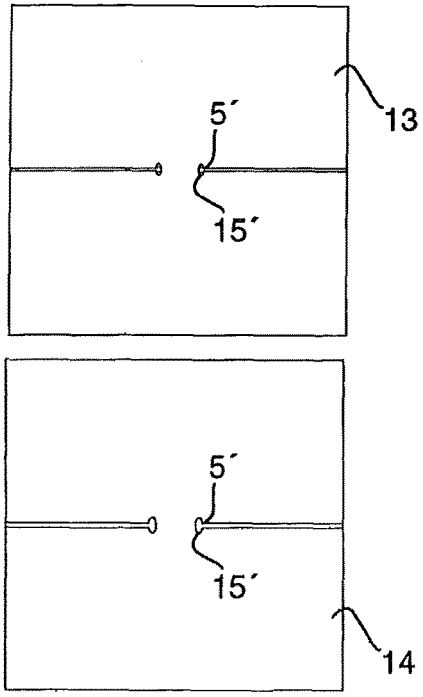
FIG. 4 shows parts of pairs of male 13 and female dies 14 according to an embodiment.
Figure 5:
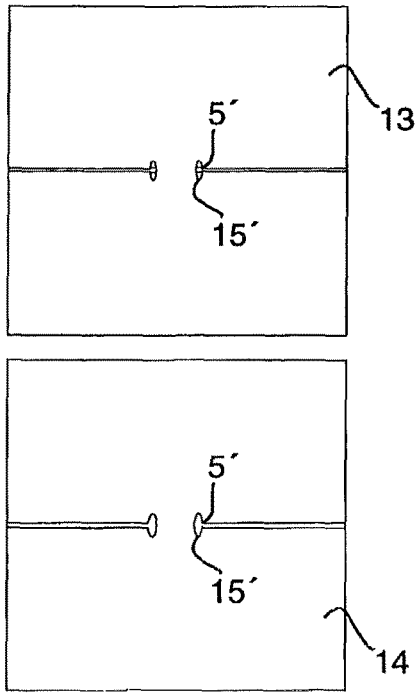
FIG. 5 shows parts of pairs of male 13 and female dies 14 according to another embodiment.

The technology representative to the present invention relates to a case where it is an aim to create lanes 21, 22 of unfolded package blanks 2 or separate unfolded package blanks, each blank 2 having a structured pattern of creasing lines 1, from a large roller containing a preferably preprinted, cardboard material of at width equaling at least the with two lanes 21, 22 of package blanks 2 (cf. FIG. 1). The roll with the blanks 2 may be produced in situ where the blanks 2 later are folded, filled, sealed and finally folded, but may also be produced elsewhere, and thereafter transported as rollers or in a kind of magazines to a final user and there be inserted into a packaging machine performing the above mentioned steps following the creasing.

As described above, the tensile stress in the cardboard material in the vicinity of the ends of each of the male crease protrusions in conventional creasing may give rise to wild creases. The structured patterns of creasing lines 1 comprises creasing lines with closed ends 25, i.e. lines ending in another line, typically perpendicular to the first line. Further, the structured patterns of creasing lines 2 also comprises creasing lines with open ends 5, i.e. lines not ending in another line. Such open ends 5 are typically present in the area 26 of a package blank 2 where a longitudinal seal is to be made.

Typically, wild-creasing occurs between the open ends 5 of the adjacent creasing lines, being perpendicular to the direction of the motion of the web in the creasing process. Is has been found that wild creasing may be prevented, or at least reduced, by providing the open ends 5 with crease stoppers 15'. The crease stopper 15' may be a branching at the open end 5 of the creasing line. Typically the branches extend transversally outwards from the open end, such that they have at least a vector component that is perpendicular with respect to the creasing line (cf. FIG. 7, wherein dies for obtaining crease stopper are depicted), such as fully perpendicular, angled with respect of the creasing line, being circle or bracket shaped etc., which will be further described below. By applying ends diverting from the direction of the creasing line, the tendency for formation of wild creases may prevented, or at least reduced. Typically, the length of the branches is 2 to 15 mm, such as 3 to 7 mm. The branches may also be arched (cf. FIG. 6, wherein dies for obtaining crease stopper are depicted).

Since the crease stopper 15' is intended to prevent wild creases running from a creasing line, also other geometries than branching may be used. Wild creases typically emanates from the creasing line in an orientation corresponding to the orientation of the creasing line, thus the crease stopper 15' is designed to discontinue the orientation of the typically linear crease. As an example the open end of a creasing line may be provided with a circular or elliptic crease stopper.

Figure 9:
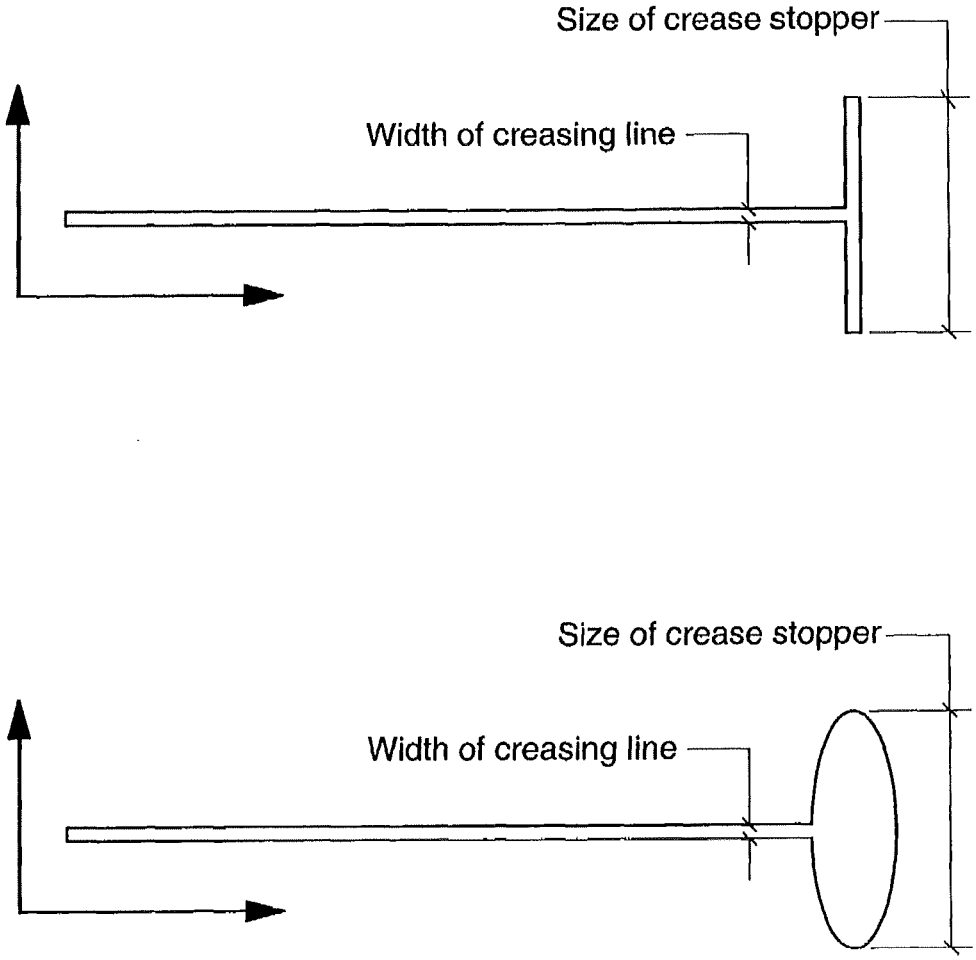
FIG. 9 shows two examples of crease stoppers according to embodiments disclosed herein.

The crease stopper 15' may also have other shapes, as long as size of the crease stopper 15' perpendicular to the creasing line is at least two times the width of the creasing line (cf. FIG. 9). The crease stopper 15' may be obtained by including a corresponding pattern in the structured pattern of lines of the dies in a creasing machine (cf. FIG. 4-7). Thus, the crease stopper 15' may be a creasing, formed when forming the creasing lines, and in a corresponding way as when forming the creasing lines. Although the creasing line typically is a straight line, it may also for example be arched or curved. For non-straight creasing lines, the size of the crease stopper 15' is defined with respect to its orientation, i.e. derivative, in the open end 5.

Thus, an embodiment relates to an arrangement in a cardboard creasing machine for forming structured patterns of creasing lines 1 in a material comprising a cardboard web fed to the machine. As already described, the material comprising a cardboard web is subsequently to be cut into blanks 2, each with a structured pattern of creasing lines 1. The arrangement comprises a system of at least two rollers 3, 4 provided with a male 13 and female die 14, respectively.

The first roller 3, being provided with the male die 13, has at least two envelope surfaces being arranged along the rotation axis of the roller 3. Thereby, structured patterns 1 arranged in at least two lanes 21, 22 along the length of the web may be accomplished upon usage of a cardboard creasing machine equipped with such an arrangement. The envelope surfaces each have a structured pattern of lines. Typically, those patterns are essentially identical, as they are to produce creasing lines for the same type of package. At least one of these lines in the structured pattern of lines has an open end 5'. The lines of the male die 13 are protrusions, which may have a width of 0.5 to 3 mm and a height of 0.5 to 3 mm.

The second roller 4, being provided with the female male die 14, corresponding to the male die 13 of the first roller 3, has at least two envelope surfaces being arranged along the rotation axis of the roller 4. The envelope surfaces each have a structured pattern of lines. At least one of these lines has an open end 5'. The lines of the female die 14 are recesses, which may have a width of 1 to 5 mm and a height of 0.5 to 3 mm. The width of the recesses is larger than the width of the protrusion of the male die 13.

In order to prevent wild crease, lines with an open end 5' are provided with a crease stopper 15', extending perpendicular to the line with the open end 5', as already have been described herein above. The size of the crease stopper 15', perpendicular to the line provided with the crease stopper 15', is typically at least 2 times the width of the line with said open end (cf. FIG. 9).

Figure 6:
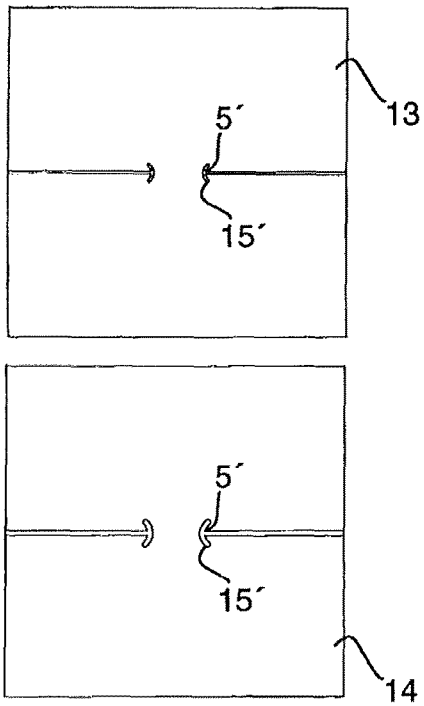
FIG. 6. shows parts of pairs of male 13 and female dies 14 according to another embodiment.
Figure 7:
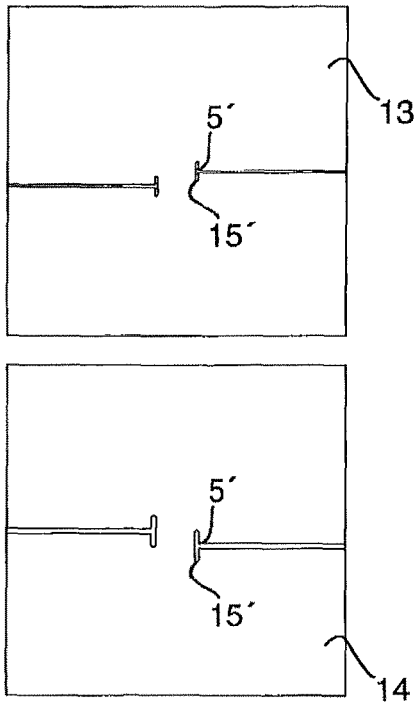
FIG. 7. shows parts of pairs of male 13 and female dies 14 according to another embodiment.

According to an embodiment, the crease stopper 15' is a branching of the line with the open end 5 provided with the crease stopper 15'. The branches may be straight (cf. FIG. 7). Straight branches may be substantially perpendicular with respect to the line with an open end 5' from which they branch. Further, may the branches be substantially perpendicular with respect to the rotation axis of the roller. The branches may also be arched (FIG. 6). The length of the branches may be 2 to 15 mm, such as 3 to 7 mm.

According to an embodiment the crease stopper 15' is circular. The diameter of the circle is then at least 2 times the width of the line provided with the crease stopper 15'. Alternative is the crease stopper 15'elliptic (cf. FIGS. 4 and 5). The transverse diameter of the ellipse is then at least 2 times the width of the line provided with the crease stopper 15'. Typically, the ellipse is arranged in a manner such that its transverse axis is perpendicular with respect to the line provided with the crease stopper 15'.

In the structured pattern of lines described herein, lines having an open end 5' are typically parallel with respect to the rotation axis of the roller.

Wild creasing may be further limited by avoiding having aligned creasing lines with open end 5', ending close to each other. Thus, the structured pattern of creasing lines 1 in adjacent lanes 21, 22 of the material comprising the cardboard web may be displaced with respect to each other (cf. FIG. 1). According to an embodiment, adjacent envelope surfaces with the same structured pattern of lines are thus arranged at the first 3 and second roller 4, respectively, displaced with respect to each other in a manner such that adjacent lines having open ends 5' not are aligned with respect to each other.

As the dies eventually may be worn out, they may be releasably attached to their corresponding roller 3, 4. Further, the dies 13, 14 may be creasing plates, having the shape of a semicylindrical shell. Such creasing plates may be rigidly (bolt-) mounted to its corresponding roller for a long but anyway limited life as a wear-plate. Such wear-plates are designed to be used for a certain amount of repetitions and are thereafter recycled. It should for clarification purposes be mentioned that wear plates by no means are necessary. The creasing pattern, i.e. the structured pattern of lines, may also be formed directly on the rollers. Each of the creasing plates may be provided with a number of holes and cavities, where the holes are provided to constitute means for correctly aligning the plates to its respective roller and the cavities are provided to constitute countersinked cavities for the fitting bolts for obtaining a secure fixation of the plates at their respective roller.

Another embodiment relates to material, such as packing material, comprising a cardboard web, the material being provided with structured patterns of creasing lines 1, wherein at least one creasing line with an open end 5 is provided with a crease stopper 15'. Such a material may be obtained by providing the material with creasing lines by use of such an arrangement in a cardboard creasing machine as just have been described. The structured patterns 1 are arranged in at least two lanes 21, 22 along the length of the material to provide the material with two lanes 21, 22 with structured patterns 1. Before usage, the lanes 21, 22 are separated from each other. The material is typically winded up into rolls subsequent to have been provided with creasing lines. Such rolls may be cut into smaller rolls, each comprising one of the lanes. The lanes are further adopted to be cut into blanks 2. The blanks 2 are intended to be folded along said creasing lines to form e.g. a package. Further, each blank 2 has a structured pattern of creasing lines 1, of which at least one creasing line has an open end 5 provided with a crease stopper 15'. The size of said crease stopper 15', perpendicular to the creasing line provided with said crease stopper 15', is at least 2 times the width of the creasing line provided with said crease stopper 15'.

According to an embodiment, the crease stopper 15' is a branching of the creasing line provided with the crease stopper 15'. The branches may be straight. Straight branches may be substantially perpendicular with respect to the creasing line from which they branch. Further, the branches may be essentially parallel with respect to length axis of the material. The branches may also be arched. The length of the branches may be 2 to 15 mm, such as 3 to 7 mm.

According to another embodiment the crease stopper 15' is circular. The diameter of the circle is then at least 2 times the width of the line provided with the crease stopper 15'. Alternatively, the crease stopper 15' is elliptic. The transverse diameter of the ellipse is then at least 2 times the width of the line provided with the crease stopper 15'.

Most of the creasing lines have closed ends 25, as they end in other creasing lines. However, creasing lines perpendicular to the lanes 21, 22 of structured patterns 1, and ending in an area 26 of a package blank where a longitudinal seal is to be made, typically have open ends 5. Thus, according to an embodiment, the creasing line provided with the crease stopper 15' is a straight creasing line being perpendicular with respect to the lanes 21, 22 of structured patterns 1.

In addition to the use of crease stoppers 15' also other steps may be taken to limit wild creasing. According to an embodiment, the structured pattern of creasing lines 1 of blanks 2 in a first lane 21 is thus displaced with respect to the structured pattern of creasing lines 1 of blanks 2 in a second adjacent lane 22, in a manner such that the creasing lines with open ends 5 in adjacent lanes 21, 22 not are aligned (cf. FIG. 1). Thereby, the tendency of wild creasing is lowered.

The material provided with provided with structured patterns of creasing lines 1, wherein at least one creasing line with an open end 5 is provided with a crease stopper 15' is, according to an embodiment, a packing material, such as liquid food packaging material comprising various layers. According to an embodiment, such a packing material comprises an innermost layer (optionally being a multi-layer film) of a thermoplastic polymer, such as a polyolefin, intended to be in contact with the product, such as liquid food. Further, the packing material comprises a cardboard web. Between the cardboard web and the innermost layer is a barrier layer arranged. The outermost layer of the packing material is a thermoplastic polymer layer not intended to be in contact with the product. The barrier layer may be a gas barrier, such as an oxygen barrier; a water vapor barrier; light barrier or odour barrier. An example of a barrier material is an aluminum foil or a film containing a metal vapour deposited layer. Other barrier materials are ethylene vinylalcohol copolymer (EvOH) and polyamide (PA). Optionally an adhesive layer in order to promote the adhesion is used between for example the barrier layer and the innermost layer.

The innermost and the outermost layer may be a low density polyethylene selected from LDPE, LLDPE, mLLDPE and VLDPE or blends thereof. The innermost layer is possible to heat seal. Independently of each other the adhesive layer and the bonding layer may be an ethylene acrylic acid copolymer (EAA), ethylene methacrylic acid copolymer or an LDPE.

Figure 8:
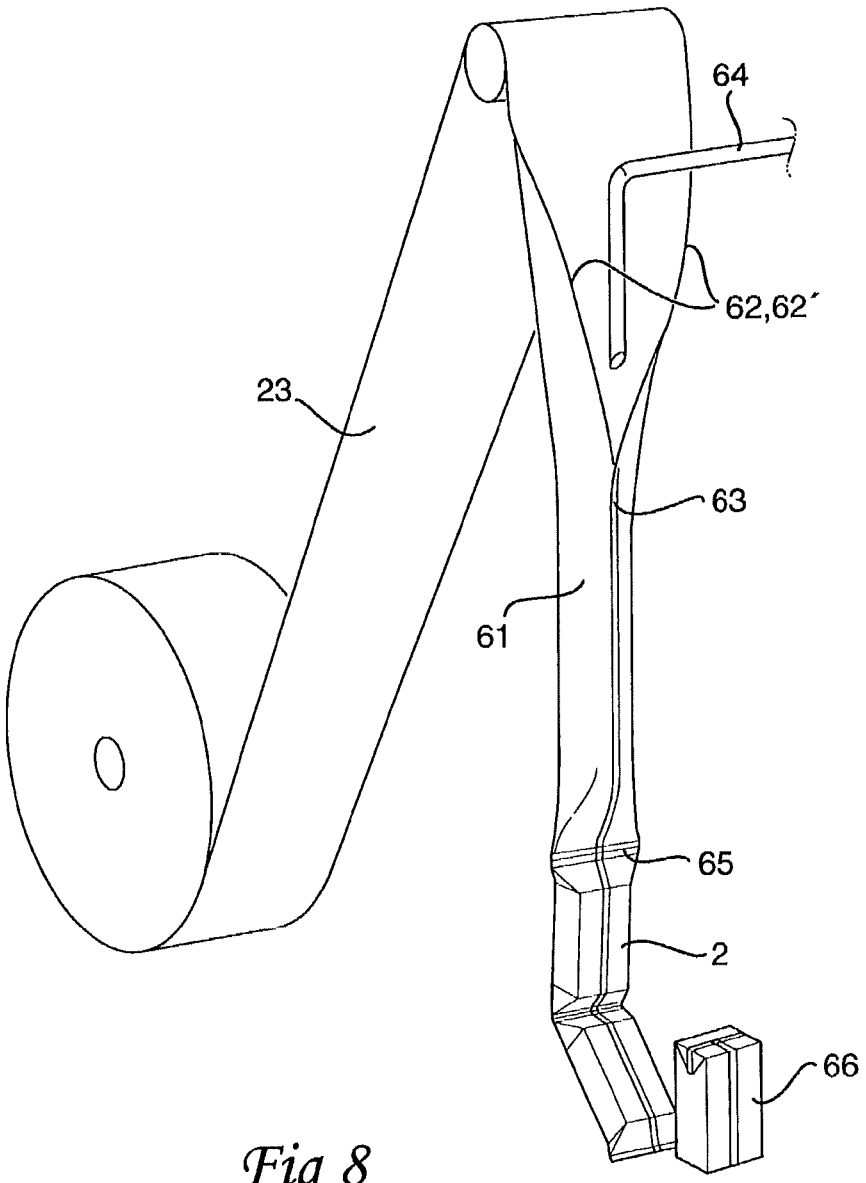
FIG. 8 shows a filling machine.

A further embodiment relates to a liquid food package comprising such a food packaging material described herein above, wherein the material has been folded along the creasing lines and sealed to obtain a liquid food package. The liquid food package may be obtained by a roll fed system where the packaging material is fed to the filling machine. FIG. 8 schematically illustrates a roll fed filling machine where the packaging material is sterilized, folded into a tube 61 and longitudinally sealed 63. The longitudinally sealed tube is filled with product 64 before being transversally sealed 65. The sealing may be done by induction sealing or ultrasonic sealing. The sealed package is thereafter cut and finally folded along the creasing line into a package 66. Alternatively the packaging material may be pre-cut before used in the filling machine.

The packaging material may be fed to filling machine from a roll. Such a roll may be obtained by be separating, typically by cutting, the various lanes 21, 22 of a material being provided with structured patterns of creasing lines 1 and described herein to obtain a separate lane 23 of continuous blanks 2 with a structured pattern of creasing lines 1. Thus, an embodiment relates to a lane 23 of continuous blanks 2 obtained from the material provided with structured patterns of creasing lines 1 and described herein, by separating the various lanes of said material.

A further embodiment relates to a method of providing a material comprising a cardboard web with structured patterns of creasing lines 1, wherein at least one line has an open end 5 provided with a crease stopper 15'. Such a material has been descried herein. In the method, the material to be provided with creasing lines is fed to a cardboard creasing machine. The machine is provided with such an arrangement as has been describe herein. By passing the material between the first 3 and the second roller 4, it is provided with creasing lines.

Without further elaboration, it is believed that one skilled in the art can, using the preceding description, utilize the present invention to its fullest extent. The preferred specific embodiments described herein are, therefore, to be construed as merely illustrative and not limitative of the remainder of the description in any way whatsoever. Further, although the present invention has been described above with reference to specific embodiments, it is not intended to be limited to the specific form set forth herein. Rather, the invention is limited only by the accompanying claims and, other embodiments than the specific above are equally possible within the scope of these appended claims, e.g. different than those described above.

In the claims, the term "comprises/comprising" does not exclude the presence of other elements or steps. Additionally, although individual features may be included in different claims, these may possibly advantageously be combined, and the inclusion in different claims does not imply that a combination of features is not feasible and/or advantageous.

In addition, singular references do not exclude a plurality. The terms "a", "an", "first", "second" etc do not preclude a plurality.

The invention claimed is:

1. Arrangement in a cardboard creasing machine, for forming structured patterns of creasing lines in a material comprising a cardboard web fed to the machine, wherein the material comprising the cardboard web subsequently is to be cut into blanks, each with a structured pattern of creasing lines, said arrangement comprising a system of at least two rollers, the first roller being provided with a male die, having at least two envelope surfaces, each with a structured pattern of lines, at least one line of the structured pattern of lines extending in a linear direction and possessing an open end, the open end being a termination point of the at least one line, wherein an adjacent portion of the envelope surface in the linear direction is devoid of the structured pattern, the material contacted by the adjacent portion of the envelope surface remaining uncreased, wherein said envelope surfaces are arranged parallel to the rotational axis of the first roller, the second roller being provided with a female die, having at least two envelope surfaces, each with a structured pattern of lines, corresponding to the structured pattern of the first roller, wherein said envelope surfaces are arranged parallel to the rotational axis of the second roller, wherein said rollers are arranged in a manner, the male and female dies interact to provide patterns of creasing lines on the material comprising the cardboard web fed to the machine in a longitudinal direction when the machine is used, the cardboard web possessing a width direction transverse to the longitudinal direction, the cardboard web comprising a panel with two lateral outer edges spaced apart in the width direction, wherein said male and female die being provided with the structured patterns, the open end of the at least one line is provided with at least one crease stopper, wherein at least a vector component of said at least one crease stopper extends perpendicularly to the open line upon which is provided the at least one crease stopper, the open end provided with the at least one crease stopper being located adjacent to one lateral outer edge of the two lateral outer edges of the panel when the rollers provide the patterns of the creasing lines on the material, and wherein said crease stopper is a branching of said at least one line with said open end.

2. Arrangement according to claim 1, wherein said crease stopper is at least 2 times the width of the line with said open end, and extends on one or two sides of said open line.

3. Arrangement according to claim 1, wherein said at least one line with an open end is a straight line being parallel to the rotation axis of the roller.

4. Arrangement according to claim 3, wherein said at least two envelope surfaces of each roller have the same structured pattern of lines, said at least two envelope surfaces being displaced with respect to each other in a manner such that the at least one line with an open end in one envelope surface is spaced apart from the corresponding line in the adjacent structured pattern of lines in the longitudinal direction.

5. Arrangement according to claim 1, wherein the male and/or the female die is releasably attached to its corresponding roller.

6. Arrangement according to claim 1, wherein said crease stopper is circular, the diameter of said circle being at least 2 the width of the line ending in said open end provided with the crease stopper, or wherein the said crease stopper is elliptic, the transverse diameter of said ellipse being at least 2 times the width of the line ending in said open end provided with the crease stopper.

7. A material comprising cardboard web, the material being provided with structured patterns of creasing lines, the structured patterns being arranged in at least two lanes along the length of the material, the at least two lanes each comprising two outer lateral edges spaced apart in a width direction, the material being cuttable into blanks, each with a structured pattern of creasing lines, at least one line of the structured pattern of lines extending in a linear direction and possessing an open end, the open end being a termination point of the at least one line, wherein an adjacent portion of the envelope surface in the linear direction is devoid of the structured pattern, the material contacted by the adjacent portion of the envelope surface remaining uncreased, wherein the blanks are to be folded along said creasing lines, wherein the open end of said at least one creasing line is provided with a crease stopper, wherein at least a vector component of said crease stopper extends perpendicular to the creasing line upon which is provided the crease stopper, the open end provided with the crease stopper being positioned adjacent to one lateral outer edge of the two lateral outer edges of the lane, and wherein said crease stopper is a branching of said at least one creasing line with said open end.

8. The material according to claim 7, wherein the crease stopper being at least 2 times the width of the creasing line provided with said crease stopper.

9. The material according to claim 8, wherein said crease stopper is circular, the diameter of said circle being at least 2 the width of the creasing line provided with the crease stopper, or wherein the said crease stopper is elliptic, the transverse diameter of said ellipse being at least 2 times the width of the creasing line provided with the crease stopper.

10. The material according to claim 8, wherein said material a liquid food packaging material comprising an innermost thermoplastic layer, to be in contact with the liquid food, said cardboard web, an barrier material, arranged between the innermost thermoplastic layer and the cardboard web, and an outermost thermoplastic polymer layer.

11. A liquid food package comprising:

a folded blank cut from the liquid food packaging material according to claim 10.

12. A lane of blanks comprising:

the material according claim 8, the lane of blanks obtained by separating the various lanes of said material.

13. The material according to claim 7, wherein said creasing line with the open end is straight and perpendicular to the lanes of structured patterns.

14. The material according to claim 13, wherein the cardboard web possesses a longitudinal direction, the structured pattern of creasing lines of blanks in a first lane is spaced apart from the structured pattern of creasing lines of blanks in a second lane in the longitudinal direction.

15. A method comprising:

feeding a material comprising a cardboard web to a cardboard creasing machine comprising a first roller provided with a male die and a second roller provided with a female die;

pressing structured patterns of creasing lines into the material comprising the cardboard web, the structured patterns being arranged in at least two lanes along the length of the web, the at least two lanes each comprising two outer lateral edges spaced apart in a width direction, the cardboard web being cuttable into blanks, each with a structured pattern of creasing lines, at least one line of the structured pattern of lines extending in a linear direction and possessing an open end, the open end being a termination point of the at least one line, wherein an adjacent portion of the envelope surface in the linear direction is devoid of the structured pattern, the material contacted by the adjacent portion of the envelope surface remaining uncreased, the open end of said at least one creasing line being provided with a crease stopper, wherein at least a vector component of said crease stopper is extending perpendicular to the lanes of structured patterns, the open end provided with the crease stopper being positioned adjacent to one lateral outer edge of the two lateral outer edges of the lane, and said crease stopper being a branching of said at least one line with said open end.

16. The method according to claim 15, wherein said crease stopper is at least 2 times the width of the creasing line with said open end upon which it is provided.

* * * * *